United States Patent [19]

Olsson

[11] Patent Number: 4,770,211

[45] Date of Patent: Sep. 13, 1988

[54] METHOD FOR THAWING OUT ROAD CULVERTS CHOKED WITH ICE

[76] Inventor: Lars-Uno Olsson, Heden 4084, S-780 53 Nås, Sweden

[21] Appl. No.: 931,722

[22] PCT Filed: Feb. 24, 1986

[86] PCT No.: PCT/SE86/00080

§ 371 Date: Oct. 24, 1986

§ 102(e) Date: Oct. 24, 1986

[87] PCT Pub. No.: WO86/04939

PCT Pub. Date: Aug. 28, 1986

[30] Foreign Application Priority Data

Feb. 25, 1985 [SE] Sweden ..... 8500914

[51] Int. Cl.[4] ..... E03B 7/10; F16L 53/00

[52] U.S. Cl. ..... 138/32; 138/28; 138/35

[58] Field of Search ..... 138/26, 28, 32, 35; 254/262, 263, DIG. 14; 405/124, 130, 131; 137/301

[56] References Cited

U.S. PATENT DOCUMENTS

| | | | |
|---|---|---|---|
| 596,062 | 12/1897 | Firey | 138/28 |
| 678,118 | 7/1901 | Kruschke . | |
| 926,092 | 6/1909 | Bright | 138/28 |
| 2,029,630 | 2/1936 | McMichael | 138/28 |
| 2,676,607 | 4/1954 | Carr et al. | 138/32 X |

FOREIGN PATENT DOCUMENTS

| | | | |
|---|---|---|---|
| 1122877 | 5/1982 | Canada | 138/32 |
| 1219487 | 5/1960 | France | 138/28 |
| 2478161 | 9/1981 | France . | |
| 80034861 | 11/1981 | Sweden . | |
| 1345 | 1/1891 | United Kingdom | 138/28 |
| 15138 | 7/1892 | United Kingdom | 138/28 |
| 1288677 | 9/1972 | United Kingdom . | |
| 836271 | 6/1981 | U.S.S.R. . | |
| 901427 | 1/1982 | U.S.S.R. . | |

*Primary Examiner*—James E. Bryant, III

*Attorney, Agent, or Firm*—Witherspoon & Hargest

[57] ABSTRACT

Method for clearing a road culvert or the like which is choked with ice, wherein a substantially homogeneous rope of a material having at least a certain reversible extensibility is extended through the culvert from its inlet side to its outlet side and wherein the rope in its unloaded condition is clamped in connection with the outlet side and the inlet side respectively of the culvert so that the rope extends through the culvert.

4 Claims, 3 Drawing Sheets

Fig. 5
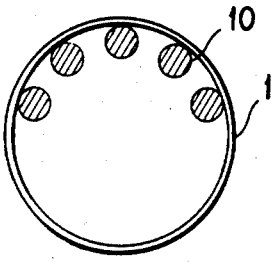
Fig. 6
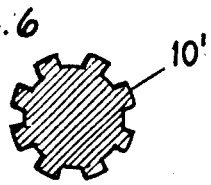
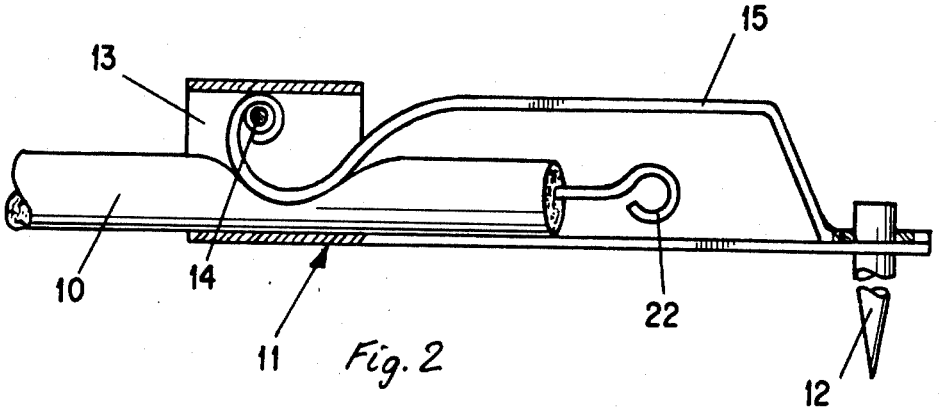
Fig. 2
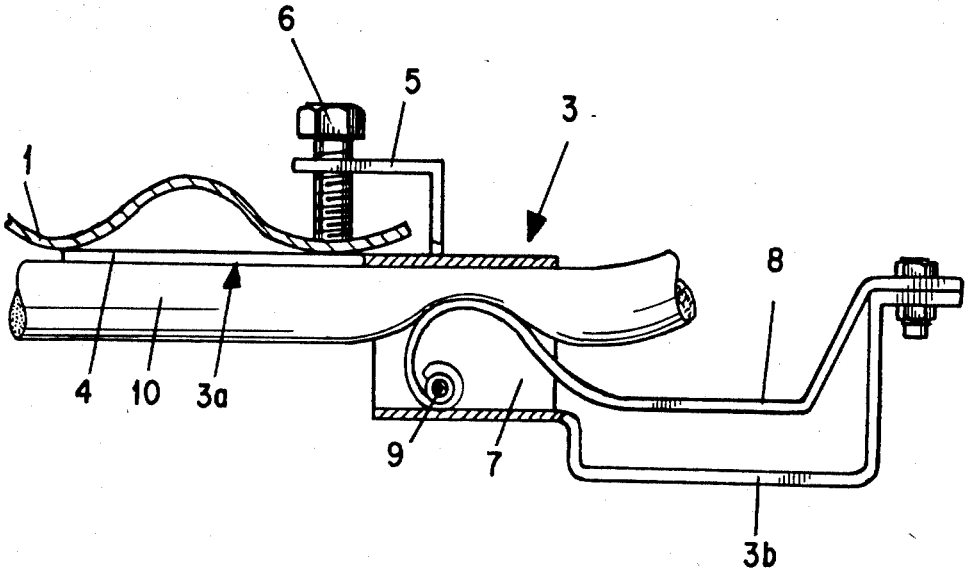
Fig. 3

Fig. 4a
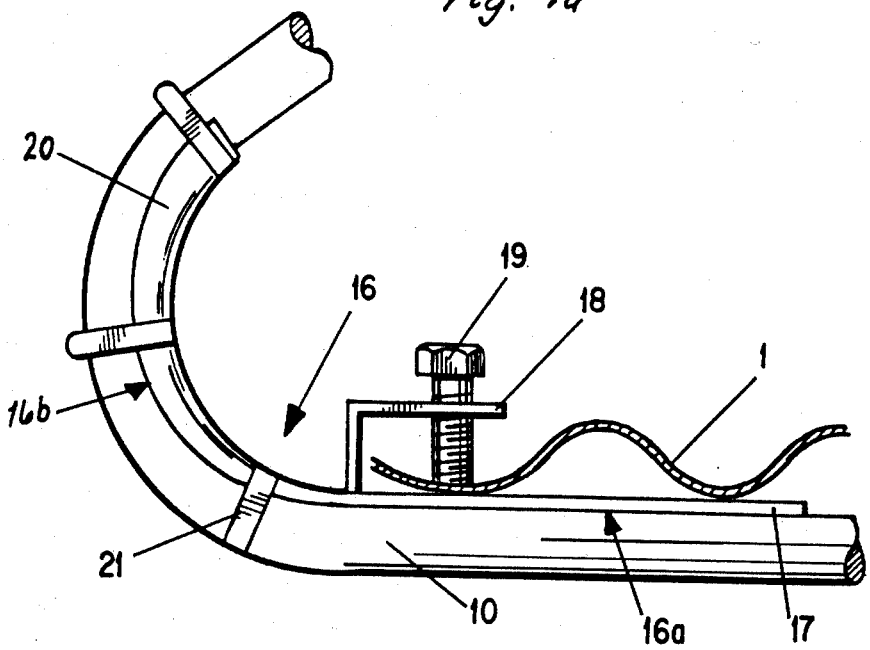
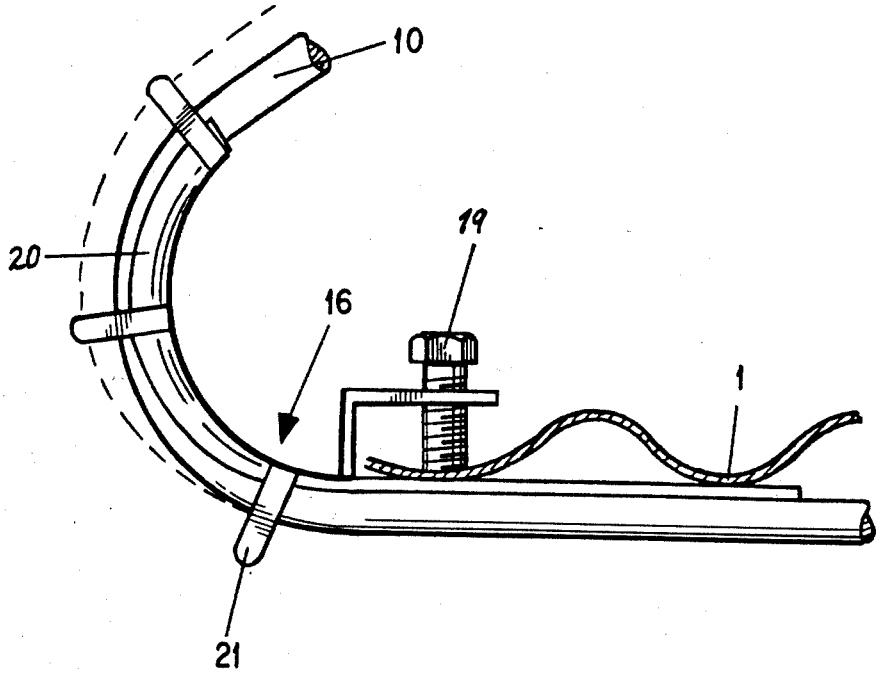
Fig. 4b

METHOD FOR THAWING OUT ROAD CULVERTS CHOKED WITH ICE

BACKGROUND OF THE INVENTION

The present invention relates to a method for thawing out road culverts choked with ice and also relates to an apparatus for carrying out said method.

A common problem in connection with winter maintenance is that road culverts become completely choked with ice, which makes it impossible to drain melted ice through the road culverts in warm weather, and especially by the spring flood. If such a road culvert that is completely choked with ice is not thawed out before the spring flood this may cause serious flooding and also a danger of parts of the road way being washed away.

In order to prevent the above mentioned, serious consequences of a road culvert choked with ice it is presently common practice to continously inspect road culverts which by experience are known to cause problems. When a road culvert choked with ice is found during such a periodical inspection, the procedure is presently to send out a clearing partrol, usually two persons, by car for thawing out the road culvert in question. Today steam generators are mostly used for thawing out road culverts in this manner, although attempts have also been made to use conventional building dryers. Already from the above it is clear that the thawing out of a road culvert in the conventional manner brings about relatively high costs which apart from transport costs also include wage costs for two persons and the cost for the steam generator.

Apart from the fact that the conventional clearing method discussed above is relatively expensive it also suffers from a number of more or less serious disadvantages that are clear from the following general description of the presently employed method using steam thawing. As indicated above a steam generator is transported out to the working place on a lorry or the like, and when the ends of the road culvert have been exposed the steam generator is started and is connected through hoses to steam pipes used for the thawing. In certain cases it is only necessary to thaw out a smaller passage through the culvert, whereupon the flow of water through this smaller passage continues to widen the passage in the ice until the culvert is completely cleared. In such a case it is, for obtaining the best result, absolutely necessary that the first thawing out of the smaller passage is carried out relatively close to the upper portion of the road culvert since the water will eat its way down through the ice towards the bottom of the culvert. Since road culverts may have a length of up to 15–20 meters, depending upon the width of the road, such a thawing out of a first small passage through the entire length of the road culvert is very difficult to achieve with a satisfactory result by means of a steam pipe. The reason for this is that if the steam pipe has such a length that it may reach through the entire length of the road culvert it will not be possible to keep it close to the upper portion of the road culvert throughout the entire length thereof and accordingly the steam pipe will deflect such that in the worst case it will leave the culvert close to its bottom. Accordingly it may also happen that the steam pipe will be stopped and cannot be brought through the entire length of the road culvert in case stones have fallen into the road culvert and remained therein on the bottom of the culvert.

In other cases it is not sufficient to thaw out only a smaller passage in the road culvert in order to avoid flooding, and therefore it will be necessary to clear the whole culvert in order to avoid the risk that a smaller passage is frozen again. It will also be realized that in the above discussed case where it proves impossible even to thaw out a first small passage in the road culvert by means of a steam pipe, it may become necessary to clear the whole culvert. In such a case when the whole culvert is to be cleared the procedure is such that a number of unperforated steam pipes, being upon in the outer end and having a length of approximately 3 meters are successively introduced from the outlet side of the culvert. When these unperforated pipes have been inserted to their full length they are withdrawn and are exchanged for perforated steam pipes which are fixed in position. Then steam is turned on to perform its thawing action until this length of the culvert may be cleared. This procedure is repeated until the culvert has been cleared throughout its length. The last portion of the length of the culvert is usually cleared from its inlet side, but it will be realized that if the culvert has a length of 10–15 meters and possibly even 20 meters it will be necessary for the persons performing the clearing to crawl into the culvert in order to be able to carry out a great deal of the work. Even if this work is not extremely risky it is cold and damp and generally unpleasant. Naturally such a clearing of a complete culvert is very time consuming, and especially so by larger culvert diameters and lengths.

SUMMARY OF THE INVENTION

The object of the present invention is to provide a method and an apparatus by means of which the above discussed disadvantages in connection with conventional methods may be eliminated as far as possible.

This object is achieved by means of a method and an apparatus of the kind indicated in the enclosed patent claims. From the patent claims the characteristic features of the invention are also clear.

BRIEF DESCRIPTION OF THE DRAWINGS

Exemplifying embodiments of the invention are described more closely below in connection with the enclosed drawings, on which:

FIG. 2 illustrates a ground attachment of the apparatus according to the invention.

FIG. 3 illustrates a culvert attachment of the apparatus according to the invention.

FIG. 4*a* illustrates an edge cover in combination with the rope in its unloaded condition.

FIG. 4*b* illustrates the edge cover according to FIG. 4*a*, but with the rope in its loaded condition.

FIG. 5 illustrates a modified embodiment with several apparatuses according to the invention positioned in a road culvert, and FIG. 6 illustrates another embodiment of the rope having an alternative cross-sectional shape.

Figure 1:
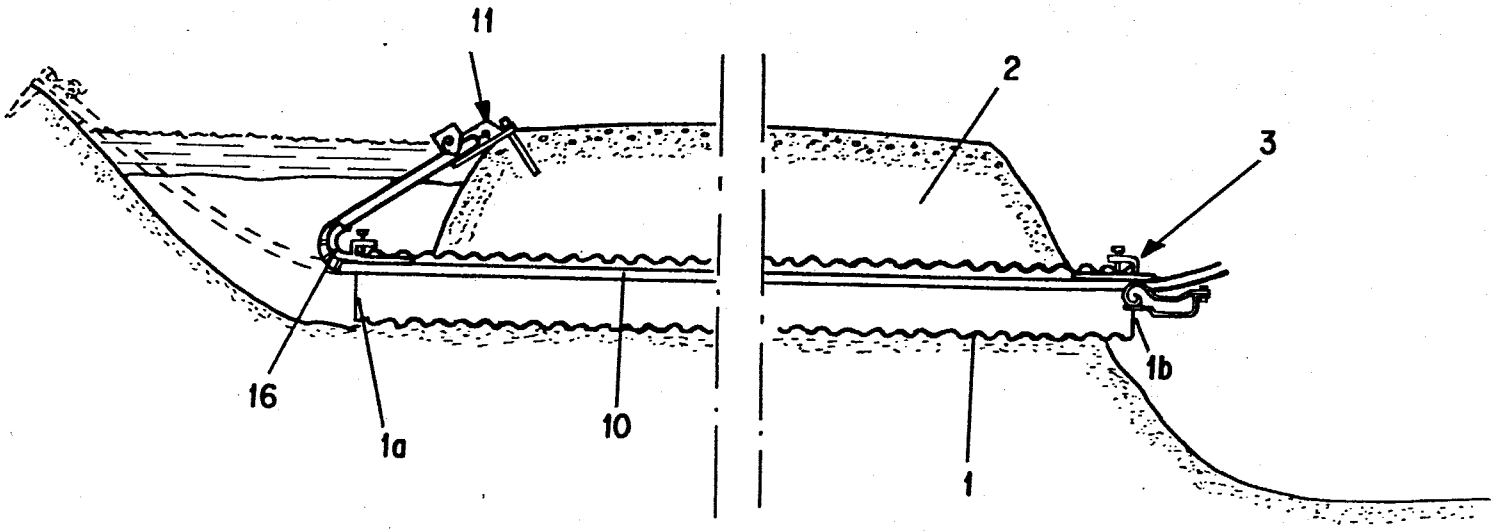
FIG. 1 is a schematic illustration of the principles of the present invention in connection with a road embankment with a road culvert, both in cross section.

Although the invention is described herein with reference only to the clearing of a road culvert, it should be obvious that the invention with the same advantage may be used for thawing out other types of culverts for draining off melted ice and/or rain-water. An example of this may be culverts used in fields by farmers in order to prevent flooding of the fields.

DETAILED DESCRIPTION OF PREFERRED EMBODIMENTS

FIG. 1 schematically illustrates the use of the invention by a road culvert 1 extended through a road embankment 2 in order to conduct melted ice and/or rainwater from an inlet side 1*a* to an outlet side 1*b*. Mostly the outlet side 1*b* of the culvert is relatively freely accessible from the outside even if the road culvert 1 is completely choked with ice, and thus, for reasons which will be explained below, a culvert attachment 3 is positioned in connection with the outlet and 1*b* of the culvert. An embodiment of the culvert attachment 3 is illustrated in greater detail in FIG. 3 from which it is clear that the culvert attachment has a first portion 3*a* intended to be clamped to the culvert. In the illustrated embodiment the first portion 3*a* comprises an inner leg 4 and an outer leg 5 between which the culvert 1 is introduced and clamped by means of a bolt 6 engaging a threaded bore in the outer leg 5. The other portion 3*b* of the culvert attachment is formed integral with the first portion 3*a* and is at its outer end releasably connected to a clamping means 8, for instance by means of a screw-nut connection 8*a*. In the illustrated embodiment the clamping means 8 consists of a flat bar being bent into a helical shape in its free end for a pivotal mounting on a pin 9 being firmly connected to a plate secured to the culvert attachment substantially midway between its ends. Through the pivotal mounting of the clamping means 8 on the pin 9 a rope 10 that will be more closely described below may be released and clamped between the helical end of the clamping means 8 and a portion of the culvert attachment close to the middle thereof by swinging the clamping means 8 upwardly and downwardly respectively about the pin 9.

In connection with the inlet side 1*a* of the road culvert 1 and at a distance therefrom a ground attachment 11 is anchored in the road embarkment 2 or at some other suitable place in accordance with what will be discussed below. In FIG. 2 a suitable embodiment of the ground attachment 11 is illustrated which in one of its ends is provided with a peg 12 which is pointed in one of its ends and which is intended to be forced down into the ground for anchoring the ground attachment. In its other end the ground attachment 11 is provided with a plate 13 which essentially corresponds to the plate 7 on the culvert attachment of FIG. 3 and which accordingly is provided with a pin 14 for pivotal mounting of one end of a clamping means 15 which in turn corresponds to the clamping means 8 of FIG. 3. Thus, the clamping means 15 has a helically shaped end for mounting on the pin 14, and in its opposite end it is releasably attached to the ground attachment 11, preferably by means of a nut 15*a* screwed into a threaded upper portion of the anchoring peg 12. It will now be realized that in accordance with what has been described in connection with FIG. 3 the clamping means 15 is intended for releasably clamping the rope 10 between its helical end a portion of the ground attachment 11.

In the case illustrated in FIG. 1 where the ground attachment is anchored in connection with the road embankment 2 it also becomes necessary to provide an edge cover 16 at the inlet end 1*a* of the culvert, and this partly for guiding the rope 10 around the relatively sharp bend and at the same time also for protecting the rope. As is clear from FIGS. 4*a* and 4*b* the edge cover 16 in a suitable embodiment consists of a first portion 16*a* which to a great extent corresponds to the first portion 3*a* of the culvert attachment 3 and thus comprises an inner leg 17 and an outer leg 18 between which the culvert 1 is clamped by means of a bolt 19 screwed into a threaded bore in the outer leg 18. The other portion 16*b* of the edge cover provides the guiding proper for the rope 10 and for this purpose includes an upwardly bent guide rail 20 having a smooth curvature for deflecting the rope 10 between 90° and 180°, in the illustrated embodiment approximately 135°. For providing the best guiding the guide rail 20 has an inner, longitudinal groove having a shape essentially corresponding to that of the rope 10. For additionally securing and guiding the rope 10 in the guide rail 20 the latter is also provided with a number of guide loops 21 evenly distributed along the length of the guide rail, and through these loops the rope is threaded.

For reasons of clarity it should be mentioned that although the elongated means, which according to the invention is intended to be extended through a road culvert, herein is referred to as a rope this term is not intended to delimit the invention regarding the cross-sectional shape or surface of the elongated means. Although the rope in the illustrated embodiments has a substantially circular cross-sectional shape it is obvious that the term rope should also cover rectangular, triangular or other suitable cross-section shapes.

As mentioned above the rope 10 is intended to be extended through the road culvert 1 and to be clamped at the culvert attachment 3 as well as at the ground attachment 11. The rope is substantially solid or homogeneous (possibly with air bubbles contained in the material) and in the illustrated embodiments it has a basically circular sectional area. The rope is cut into a suitable length corresponding to the length of the road culvert to which it is to be attached. Characteristic of the rope is that it is manufactured from a material which at least to a certain degree may be reversibly extended, i.e. a material which when it is subject to a tension load undergoes a certain, not permanent, reduction in cross section. Thus, when the tension load is removed the rope shall resume its original shape. By an embodiment of the invention where a free passage is established through ice in the road culvert by simply pulling the rope out from the culvert, it is sufficient if the rope has a relatively low reversible extensibility sufficient for reducing the cross-sectional area of the rope to such a degree that it without problem is released from the surrounding ice. By another embodiment where the passage through the ice is established with the rope remaining in the culvert by extending the rope to such an extent that its cross-sectional area is greatly reduced, it must on the other hand be possible to subject the material to such a tension load that its cross-sectional area is substantially reduced to half without any danger of the material rupturing or breaking. A material that has been found suitable for the later embodiment and that complies with the requirements thereof is a synthetic rubber EPDM (SIS 1626-70).

In either or both of its ends the rope is provided with a hook 22 the function of which will be described below. In certain cases it may also be preferable to provide the free ends of the rope with a not shown web or stocking intended to protect the rope from external damage through for instance gravel and rocks.

According to an emboidment of the invention the clearing or thawing out of a road culvert is carried out in the following manner:

In good time before the winter, when the culvert is open, the above described equipment is installed, and when installed it can remain there year after year and it will not be necessary to dismount it unless some portion thereof is damaged. The assembly is carried out such that a culvert attachment 3 of the kind described above is clamped to the outlet side 1*b* of the culvert 1. The ground attachment 11 may be secured by forcing the anchoring peg 12 into the ground by means of any suitable tool so that it is firmly anchored, and the anchoring may be carried out in alternative places depending upon the surrounding terrain. Hereby it is determining that the ground attachment shall be anchored at a spot where there is little danger that it will become covered by ice during winter. The reason for this is naturally that it must be easy to get hold of the end of the rope 10 being positioned in connecton therewith without having to expose said end by chopping off ice. Of importance for the positioning is also that the anchoring position must be as close as possible to the inlet end 1*a* of the culvert so that the length of the rope may be reduced. In view of this the positioning illustrated with full lines in FIG. 1 seems to be preferable in most cases, but it is also possible to position the ground attachment as illustrated with broken lines in FIG. 1, in which case the rope will be extended obliquely upwardly in FIG. 1.

As mentioned above the positioning of the ground attachment 11 illustrated with full lines in FIG. 1 also necessitates the mounting of an edge cover 16 at the inlet end 1*a* of the culvert for deflecting and guiding the rope 10. By the alternative positioning illustrated with broken lines it would be possible to manage without any edge cover or with an edge cover of a simpler design. When the culvert attachment, the ground attachment and possibly an edge cover have been installed the rope 10 is extended through the culvert and, where appropriate, the rope is then threaded through the edge cover, and its ends are clamped to the culvert attachment and to the ground attachment respectively. The clamping is carried out in such a way that the clamping means 8 and 15 respectively is disengaged and is swung about the pin 9 and 14 respectively, whereupon the rope is installed in the respective attachment and is clamped in position by means of the clamping means which are secured by the nut 8*a* and 15*a* respectively. The rope 10 is clamped to the attachments in its substantially unloaded condition, i.e. without being subject to any essential tension load. However, especially in connection with longer road culverts it may be necessary to clamp the rope 10 when the same is subject to a certain, low tension load in order to make sure that the rope does not hang down towards the middle but runs close to the upper edge of the culvert 1 throughout its extension, and as discussed in the introduction this is essentially in order to make it possible for the water flowing through an opened passage to eat its way down in the ice so that the ice may be efficiently cleared away. The rope remains in the above described position and when it is discovered, during a routine inspection discussed above, that the culvert is completely choked with ice so that melted ice cannot be drained therethrough it will, by employing the invention, no longer be necessary to send out any special patrol for clearing the culvert, but in most cases the person carrying out the inspection may carry out the clearing by himself. By one embodiment the procedure is such that the rope is released at the culvert attachment 3 by the outlet side 1*b* of the culvert, possibly subsequent to exposing this side by removing snow, through disengaging the clamping means 8 and swinging the same about the pin 9. The rope which in this embodiment should have a high reversible extensibility is then stretched or tensioned by hand from the outlet side 1*b* while remaining clamped at the ground attachment 11, and through this tension load and due to the tensibility of the material the rope 10 is immediately released from the ice as its cross-sectional area is greatly reduced. Hereby a free passage for the melted ice is established around the circumference of rope and when this has been achieved the rope is clamped to the culvert attachment 3 again in its loaded condition so that the water may continue to flow in the passage in such a way that it wears its way through the ice and finally clears the whole culvert. When the culvert has been cleared the rope is released from the culvert attachment 3 again and is unloaded so that it resumes its original shape and finally it is clamped again so that the procedure may be repeated if the culvert should become choked with ice once more. As has been mentioned above it is obvious that the rope 10 by this embodiment should have as high a reversible extensibility as possible in order to establish the largest possible passage for the melted ice when it is stretched or tensioned. In this embodiment it may also be suitable if the rope has a rectangular cross-sectional shape in order to leave as wide a passage as possible for the melted ice to thereby ensure a positive clearing of the complete culvert.

When the ground attachment is positioned as illustrated with broken lines in FIG. 1 there is a danger that the reduction of the cross section of the rope at the end closest to the ground attachment, due to the great distance from the place where the tension load is applied, goes on so slowly that the water beginning to flow in freezes before sufficient flow has been established in order to keep the passage open. For that reason it may be preferable in all cases to use the variant illustrated with full lines in FIG. 1, having an edge cover 16. The reason for this is that when the rope is stretched about the edge cover the passage may be opened up more quickly by performing the tensioning or stretching in two different steps. In FIG. 4*a* the rope is illustrated guided about the edge cover in its unloaded condition, but in FIG. 4*b* the broken lines illustrate how the extension of the rope is blocked by the guide rail 20 of the edge cover so that the reduction of the cross-sectional area of the rope, when the rope is normally tensioned, has been fully established up to the guide rail and possibly a distance around the same, while the remaining portion of the rope still maintains its full cross-sectional dimension so that no melted ice or snow enters from above. At this state the rope is clamped at the culvert attachment 3 when in its loaded condition and the person moves to the ground attachment 11 and exposes the same when necessary. Then the rope is released at the ground attachment and since only a relatively short portion of the rope from the edge cover 16 and up to the ground attachment is unloaded this portion of the rope may quickly be stretched or tensioned so that a full flow through the established passage is immediately obtained and so that the above mentioned danger of freezing is elminated.

By certain road culverts which by experience are known to cause serious problems, or by road culverts having a large diameter it may suitable to provide several ropes 10 at a distance from each other in connection with the upper portion of the culvert, and for instance in the way schematicaly illustrated in FIG. 5. Another alternative that may be considered in connection with larger road culverts is to employ thicker ropes therein, but in such a case it may be necessary to provide some kind of not shown auxiliary device having a gear mechanism for tensioning or stretching the rope.

In FIG. 6 a rope 10′ is illustrated having an alternative cross-sectional shape with longitudinal grooves or channels. This rope is intended to be twisted in connection with the streching or tensioning thereof so that the grooves assume a screw line shape around the rope. Apart from the fact that this configuration establishes a somewhat larger passage for the melted ice it also gives the ice a non-uniform surface so that the melted ice more efficiently wears off the ice. This is even further emphasized if the grooves or channels initially are helically shaped in the rope.

In extremely difficult situations where the above described method is not sufficient or in cases where it is desirable to open up a culvert in spite of the fact that there is no water such as melted ice or snow present that can wear down through the ice during its flow through the culvert, it is in accordance with another embodiment also possible to use the invention together with a conventional steam unit or possibly together with a hot-air unit, such as a building dryer. For this purpose a hook 22 is provided in one or possibly both ends of the rope. By connecting a particular steam pipe (possibly a flexible steam hose), which is closed in one end and in said end is provided with a loop for engaging the hook 22 and which is perforated along a portion of its length, to the steam unit the complete culvert may be cleared from one side without the necessity for crawling into the culvert. This is achieved by hooking-up the loop of the steam pipe to the hook 22 of the rope, whereupon the steam pipe, through withdrawal of the rope, is pulled stepwise through the culvert as this is thawed out. Due to the fact that the steam pipe is pulled in through the passage established by the rope it will not be necessary to take up separate holes for the perforated steam pipe and moreover the complete culvert may be thawed out in one operation independent of the length of the culvert. This work is naturally speeded up even further if several ropes are installed in the culvert in accordance with FIG. 5, whereby a corresponding number of steam pipes may be used. It should be realized that by this embodiment it is, as mentioned, sufficient if the rope only has a certain reversible extensibility, since it is intended to establish a passage through the ice by being completely withdrawn from the culvert. Thus, the reduction of the cross-sectional area need only be sufficient to ensure that the rope is released from the ice.

Although preferred embodiments of the invention have been described and illustrated herein it should be obvious to those skilled in the art that a great number of changes and modifications may be carried out without departing from the scope of the invention. For instance it is possible to employ alternative designs for the culvert attachment, the ground attachment and the edge cover, both regarding their preferred clamping to the culvert, anchoring in the ground and clamping of the rope respectively. Thus, the scope of the invention should only be restricted by the enclosed patent claims.

I claim:

1. A method for clearing road culverts or the like having become choked with ice, comprising the steps of: extending a substantially homogenous rope of a material having at least a certain reversible extensibility through the culvert from its inlet side to its outlet side before it becomes choked with ice; clamping the rope in its unloaded condition in connection to the outlet side and inlet side of the culvert so that the rope extends through the culvert; and, once the culvert has become choked with ice, releasing the rope from its clamping in connection with the outlet side of the culvert; applying a tension load to the rope from the released end for reducing the cross-sectional area of the rope and thereby forming a free passage through the culvert around the circumference of the rope; clamping the rope again in connection with the outlet side of the culvert, in the loaded extended condition of the rope; and allowing a continuous flow of melted ice or snow in the passage formed around the circumference of the rope, thereby clearing the road culvert.

2. A method as described in claim 1, wherein a rope having a high reversible extensibility is used and wherein the rope is clamped close to the upper portion of the culvert.

3. A method as described in claim 2, wherein the rope in connection with the inlet side of the culvert is deflected from its extension within the culvert through an edge cover; the corresponding end of the rope is clamped at a distance from the inlet side of the culvert and both ends of the rope, one after the other, are released from the clamping, are tensioned or extended and clamped again.

4. A method for clearing road culverts or the like having become choked with ice, comprising the steps of: extending a substantially homogeneous rope of a material having at least a certain reversible extensibility through the culvert from its inlet side to its outlet side before it becomes choked with ice; clamping the rope in its unloaded condition in connection to the outlet side and the inlet side of the culvert so that the rope extends through the culvert; and, once the culvert has become choked with ice, releasing both ends of the rope at their respective clamping positions; connecting a steam pipe perforated along a portion of its length to one end of the rope; connecting the steam pipe to a steam unit; applying a tension load to the end of the rope not connected to the steam pipe, for reducing the cross-sectional area of the rope so that it is released from the ice; successively pulling the rope out from the culvert for forming a free passage through the culvert and successively pulling the steam pipe into the passage in the ice established by withdrawing the rope; thereby successively clearing the culvert by means of steam supplied from the steam unit.

* * * * *